United States Patent [19]

Karlsson et al.

[11] Patent Number: 4,800,007

[45] Date of Patent: Jan. 24, 1989

[54] CORROSION PROTECTION FOR HEAT EXCHANGERS

[75] Inventors: Bertil Karlsson, Lund; Leif Berthagen, Glumslöv, both of Sweden

[73] Assignee: Alfa-Laval Thermal AB, Lund, Sweden

[21] Appl. No.: 862,494

[22] PCT Filed: Sep. 11, 1985

[86] PCT No.: PCT/SE85/00341

§ 371 Date: May 8, 1986

§ 102(e) Date: May 8, 1986

[87] PCT Pub. No.: WO86/01837

PCT Pub. Date: Mar. 27, 1986

[30] Foreign Application Priority Data

Sep. 19, 1984 [SE] Sweden ..... 8404682

[51] Int. Cl.[4] ..... C23F 13/00

[52] U.S. Cl. ..... 204/196; 204/147; 165/166; 165/186

[58] Field of Search ..... 204/147, 148, 196, 197; 165/166, 186

[56] References Cited

U.S. PATENT DOCUMENTS

| | | | |
|---|---|---|---|
| 1,020,480 | 3/1912 | Cumberland | 204/196 |
| 3,127,337 | 3/1964 | Conger et al. | 204/196 |
| 3,349,012 | 10/1967 | Solomons | 204/435 |
| 3,378,472 | 4/1968 | Banks et al. | 204/196 |
| 3,379,629 | 4/1968 | Banks et al. | 204/196 |
| 3,461,051 | 8/1969 | Urable | 204/196 |
| 3,841,988 | 10/1974 | Gleason | 204/147 |
| 4,376,753 | 3/1983 | Lucas | 204/147 |
| 4,588,022 | 5/1986 | Sanz | 204/196 |

FOREIGN PATENT DOCUMENTS

| | | | |
|---|---|---|---|
| 18124 | 10/1980 | European Pat. Off. | 204/196 |
| 2642163 | 3/1978 | Fed. Rep. of Germany | 204/196 |

OTHER PUBLICATIONS

"Anodic Protection of Welded Plate Heat Exchangers", Alfa-Laval, pp. 1–4, 1981.

*Primary Examiner*—T. Tung

*Attorney, Agent, or Firm*—Cyrus S. Hapgood

[57] ABSTRACT

This invention relates to anodic corrosion protection for heat exchangers and comprises cathodes put into the inlet channel and the outlet channel for the corrosive medium and an anode constituted by the metal being the partition walls in the heat exchanger. The anode and the cathodes are integral parts of a direct current circuit, the amperage of which is influenced by a control reference electrode placed in the flow way for the corrosive medium. The characterizing feature of the invention is that the control reference electrode (11) is arranged in the ordinary or a separate flow way for the corrosive medium at an essential distance from the cathodes (9, 10) so that the corrosion protection of all parts of the heat exchanger, which are to be protected, is secured.

10 Claims, 2 Drawing Sheets

CORROSION PROTECTION FOR HEAT EXCHANGERS

This invention relates to corrosion protection for a heat exchanger in which a number of metal walls delimit heat exchanging flow channels for heat emitting media and heat absorbing media, respectively, which flow channels extend between inlet channels and outlet channels for respective media, the corrosion protection at least comprising one cathode placed in the flow way for the corrosive medium within the area of the inlet channel and one cathode within the area of the outlet channel for the corrosive medium, the cathodes being isolated in relation to the metal walls which constitute an anode in a direct current circuit, a control reference electrode being arranged to influence the amperage in the mentioned direct current circuit.

Anodic corrosion protection of this kind is known since long. The basic principle means that a passive oxide film is formed on the surface of the metal by maintaining an anodic potential to the same. The metal surface is passivated by putting on the same a current of relatively high density by way of introduction. As the mentioned oxide film is built up the potential increases between the mentioned control reference electrode and the metal surface, i.e. the anode. A relatively low current density is then sufficient for maintaining the potential corresponding to a passive metal surface. If the potential should be brought to increase beyond the passive potential area, the metal surface gradually begins to corrode. Different steel qualities have somewhat different passive potential areas.

The state of things appears from the enclosed FIG. 1. Usually the system is so constructed that the necessary amperage is brought about by means of an apparatus which is influenced by a control unit with the control reference electrode as a detecting means. Thus, a value for the potential measured by the control reference electrode is preset and the apparatus provides an amperage striving to bring about the wished potential. In apparatuses of the kind mentioned by way of introduction where the control reference electrode is usually placed relatively close to a cathode, it may happen that the potential measured by the control reference electrode reaches the preset value without the metal surfaces of the whole heat exchanger being passivated. This is of course a great disadvantage and may lead to a quick corrosion of the metal when there are strongly corrosive media like concentrated sulphuric acid of high temperature, for instance 110° C.

The purpose with this invention is to remove this drawback and bring about a corrosion protection of the kind mentioned by way of introduction which is reliable and secure. According to the invention such a corrosion protection is provided by the fact that the control reference electrode is arranged in a separate flow way for the corrosive medium and is spaced from the cathodes by distances such that the corrosion protection of all parts of the heat exchanger which are to be protected is secured.

Corrosion protection of the kind mentioned by way of introduction can be used in different types of heat exchangers such as heat exchangers. The separate flow way can be designed in different ways, for instance so that the corrosive medium is conducted in a partial stream to a collecting tank or returns to the actual process. In a particularly suitable embodiment of the invention the separate flow way, however, comprises a pipe line arranged like a shunt between the inlet channel and the outlet channel for the corrosive medium.

The invention shall be more closely described in the following with reference to the two accompanying figures, of which:

Figure 1:
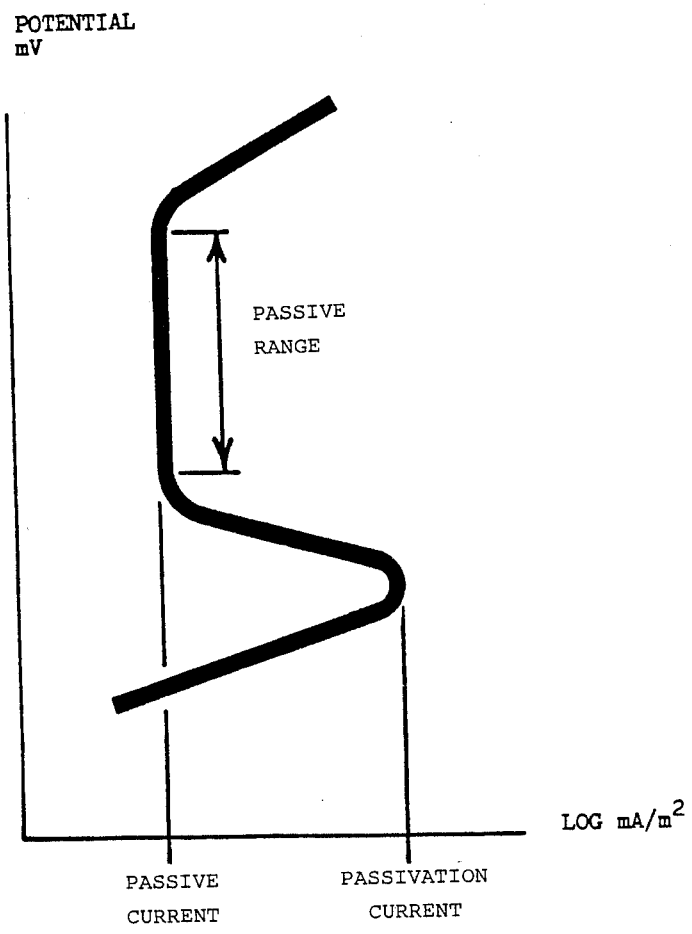
FIG. 1 shows an ideal, anodic passivation curve.
Figure 2:
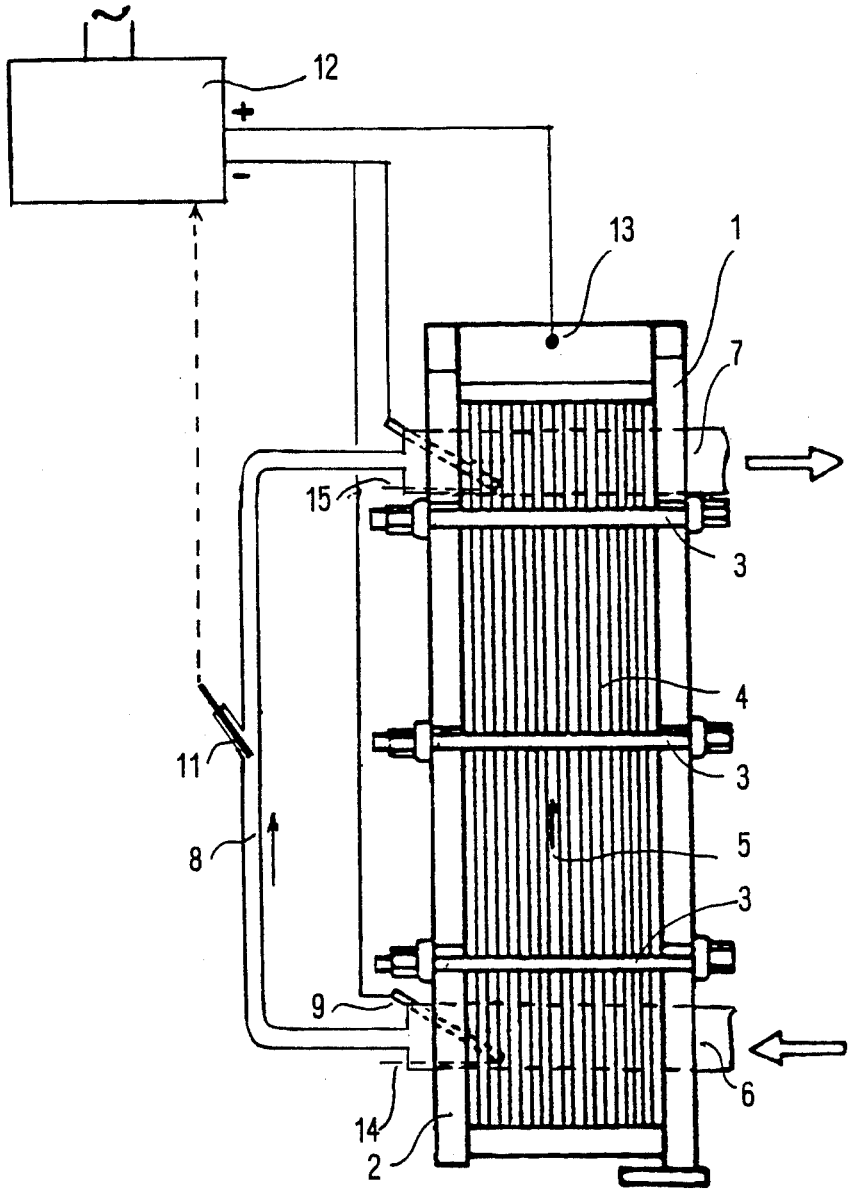
FIG. 2 shows, schematically, a plate heat exchanger with anodic corrosion protection according to the invention.

FIG. 1 has already been explained above. In FIG. 2 supporting plates 1 and 2 are kept together by bolts 3. Between the supporting plates 1 and 2 there are a number of heat exchanging metal plates 4 which n this case are welded together two and two such that heat exchanging flow channels 5 for the corrosive medium, for instance concentrated sulphuric acid of relatively high temperature, are created (of which channels only one is indicated by an arrow for the flow direction). The heat absorbing medium, in this case water, streams in channels which are tightened at the edges by gaskets. An inlet channel for a warm acid is denoted by 6 and an outlet channel for the same medium by 7. A shunt line 8 connects the mentioned inlet and outlet channels with each other. A cathode 9 is placed in the inlet channel 6 and in the outlet channel 7 a cathode 10. Each cathode 9 and 10, preferably has such a design and is so arranged that it extends along the entire channel 6 or 7. In the shunt line 8 there is a control reference electrode 11 in the form of an electrochemical semi-cell placed in the flow way for the corrosive medium and spaced from channels 6 and 7. In an arbitrary point in this shunt line 8 the temperature and the flow conditions are essentially the same as those in a corresponding point in a flow channel for the corrosive medium inside the heat exchanger. That means that when the potential is measured in a point in the shunt line, this measure is essentially the same as that one measured in a corresponding point inside the heat exchanger.

As will be noted from the above, the heat exchanger of FIG. 2 comprises means 1-4 and 8 forming a plurality of passages coupled in parallel for flow of the corrosive liquid, the passages communicating at their opposite ends with the inlet channel 6 and outlet channel 7, respectively. These passages include passages 5 defined by heat exchanging plates 4, and they also include the passage in shunt line 8 where the corrosive liquid does not exchange heat with the aforementioned heat absorbing medium. The latter medium passes through flow ways defined by plates 4 and alternating with the passages 5, as will be readily understood by those skilled in the art.

The control reference electrode 11 is preferably placed as far as possible from the cathode 9, 10. Therefore, the control reference electrode 11 is placed essentially half-way between the cathodes 9, 10.

An apparatus 12 contains a rectifier and outputs for + and − direct current connected partly with the metal plates via a connection 13 and partly with the cathodes 9 and 10. The apparatus 12 also contains control equipment which receives an input signal from the control reference electrode 11 in the form of a measure of the potential and which controls the output amperage in the direct current circuit comprising the anode, i.e. the metal plates, and the cathodes. In the inlet channel 6 there is also a monitor electrode, i.e. a measuring electrode 14, and a corresponding monitor electrode 15 in the outlet channel7. These two electrodes are not included in any regulating circuit but are only used for control.

In order to illustrate the technical effect of the invention the passivation process is shown partly for a previously known plant with a plate heat exchanger having anodic corrosion protection similar to that in FIG. 1 but without shunt line 8 and with the control reference electrode placed in the inlet channel for warm concentrated sulphuric acid.

| Time | Control Ref. Preset value mV | Electrode Real value mV | Cathode Amp | Monitor (13) mV | Electrode (14) mV |
|---|---|---|---|---|---|
| 0 | 600 | | | | |
| Current on | 600 | 200 | 15 | 700 | 1000 |
| 5 min. | 600 | 600 | 2 | 600 | 600 |

In spite of the fact that the potential measured by control reference electrode has reached the preset value 600 mV, the whole surface is still not passivated and cannot become so because the amperate is not sufficient for that (see FIG. 1).

In a plant according to the invention the following lapse is received:

| Time | Control Ref. Preset value mV | Electrode Real value mV | Cathode Amp | Monitor (13) mV | Electrode (14) mV |
|---|---|---|---|---|---|
| 0 | 600 | | | | |
| Current on | 600 | 200 | 15 | 2000 | 2500 |
| 10 h | 600 | 600 | 3 | 1000 | 1500 |
| 24–48 h | 600 | 600 | 0,5 | 700 | 800 |

In this case full passivation of the whole surface is attained. The location of the control reference electrode in the shunt line and the design of this one must be adapted for temperature and flow conditions in the actual case.

It will be understood from the foregoing that plates 4 constitute metallic first elements which transfer heat between the two liquids passing through passages 5 and the aforementioned flow ways, respectively, while second elements of the exchanger form the inlet and outlet channels 6-7. The protruding right-hand end of the element forming channel 6 constitutes means for supplying a corrosive liquid to the latter channel.

As will also be understood from the foregoing, reference electrode 11 senses a value related to the prevailing potential of said metallic elements 4 relative to the corrosive liquid; and control unit 12, connected to the direct current source shown above this unit, is operable to change the current output of said source in response to a difference between a preset value and said value sensed by electrode 11, thereby obtaining and maintaining between said metallic elements 4 and the corrosive liquid a potential within the passive range of a relevant polarization curve.

We claim:

1. A heat exchanger comprising means forming at least one flow way for a first fluid and a plurality of flow passages coupled in parallel for a second fluid, said means including metallic first elements arranged for heat transfer between fluids passing through said flow way and said flow passages, respectively, second elements forming an inlet channel and an outlet channel in communication with the respective ends of said flow passages, means for supplying a corrosive liquid to said inlet channel, separate cathodes in the inlet and outlet channels, respectively, a direct current source having a negative terminal connectd to said cathodes and having a positive terminal connected to said metallic first elements, a reference electrode arranged to sense a value related to the potential of said metallic first elements relative to corrosive liquid supplied through said inlet channel, a control unit connected to said reference electrode and said direct current source and operable to change the current output of the current source in response to a difference between a preset value and said sensed value to obtain and maintain said potential within the passive range of a relevant polarization curve, said reference electrode being located in spaced relation to said inlet and outlet channels , and means forming a separate passageway coupled in parallel with said flow passages and arranged for through flow of corrosive liquid supplied to said inlet channel, said reference electrode being located in said separate passageway.

2. The heat exchanger of claim 1, in which said separate passageway extends between said inlet channel and said outlet channel.

3. The heat exchanger of claim 2, in which said separate passageway has substantially the same length as said flow passages.

4. The heat exchanger of claim 3, in which said flow passages are formed of heat exchange plates constituting said metallic first elements.

5. The heat exchanger of claim 2, in which said flow passages are formed of heat exchange plates constituting said metallic first elements.

6. The heat exchanger of claim 1, in which said flow passages are formed of heat exchange plates constituting said metallic first elements.

7. The heat exchanger of claim 1, in which the distances between the reference electrode and the respective cathodes in said inlet and outlet channels, as seen through the corrosive liquid, are substantially the same.

8. The heat exchanger of claim 1, in which the reference electrode is spaced from each of said cathodes a distance which, as seen through the corrosive liquid, corresponds to at least half the distance between the opposite ends of a said flow passage.

9. A heat exchanger comprising means forming at least one flow way for a first fluid and a plurality of passages coupled in parallel for flow of a second fluid, said forming means including metallic first elements arranged for heat transfer between fluids passing through said flow way and at least some of said passages, respectively, second elements forming an inlet channel and an outlet channel in communication with the respective ends of said passages, means for supplying a corrosive liquid to said inlet channel, separate cathodes in the inlet and outlet channels, respectively, a direct current source having a negative terminal connected to said cathodes and having a positive terminal connected to said metallic first elements, a reference electrode arranged to sense a value related to the potential of said metallic first elements relative to corrosive liquid supplied through said inlet channel, and a control unit connected to said reference electrode and said direct current source and operable to change the current output of the current source in response to a difference between a preset value and said sensed value to obtain and maintain said potential within the passive range of a relevant polarization curve, said reference electrode being located in one of said passages in a position spaced from said inlet and outlet channels, said one passage containing the reference electrode being formed by a shunt line spaced from said metallic first elements.

10. The heat exchanger of claim 9, in which said metallic first elements are heat exchange plates.

* * * * *

UNITED STATES PATENT AND TRADEMARK OFFICE

CERTIFICATE OF CORRECTION

PATENT NO. : 4,800,007

DATED : January 24, 1989

INVENTOR(S) : BERTIL KARLSSON et al.

It is certified that error appears in the above-identified patent and that said Letters Patent is hereby corrected as shown below:

Col. 1, line 64, after "such as" insert -- for instance plate heat exchangers and tube heat exchangers. An embodiment of the invention is intended to be used for plate --.

Col. 2, line 54, change "cathode" to -- cathodes --.

Col. 3, line 22, change "amperate" to -- amperage --.

Signed and Sealed this

Twenty-sixth Day of September, 1989

*Attest:*

*Attesting Officer*

DONALD J. QUIGG

*Commissioner of Patents and Trademarks*